US011330882B1

(12) United States Patent
Doan

(10) Patent No.: US 11,330,882 B1
(45) Date of Patent: May 17, 2022

(54) CONFIGURABLE CARRYING APPARATUS

(71) Applicant: Dzuy Doan, Garden Grove, CA (US)

(72) Inventor: Dzuy Doan, Garden Grove, CA (US)

( * ) Notice: Subject to any disclaimer, the term of this patent is extended or adjusted under 35 U.S.C. 154(b) by 0 days.

(21) Appl. No.: 17/491,595

(22) Filed: Oct. 1, 2021

(51) Int. Cl.

| | |
|---|---|
| ***A45C 13/30*** | (2006.01) |
| ***A45C 13/10*** | (2006.01) |
| ***A45F 3/02*** | (2006.01) |
| ***A45F 3/14*** | (2006.01) |
| ***A45F 4/00*** | (2006.01) |
| ***A45F 3/04*** | (2006.01) |

(52) U.S. Cl.
CPC ..... *A45C 13/30* (2013.01); *A45C 13/103* (2013.01); *A45F 3/02* (2013.01); *A45F 3/04* (2013.01); *A45F 3/14* (2013.01); *A45F 4/00* (2013.01); *A45F 2003/142* (2013.01); *A45F 2004/006* (2013.01)

(58) Field of Classification Search
CPC . A45C 13/30; A45C 13/103; A45F 2003/142; A45F 3/14; A45F 2004/003; A45F 2004/006
USPC ..... 224/578–580
See application file for complete search history.

(56) References Cited

U.S. PATENT DOCUMENTS

| | | | | |
|---|---|---|---|---|
| 3,530,919 | A * | 9/1970 | May | A63B 55/40 224/583 |
| 6,138,881 | A | 10/2000 | Paul et al. | |
| 6,926,183 | B2 | 8/2005 | Chang | |
| 7,322,498 | B2 * | 1/2008 | Frost | A47D 13/025 224/160 |
| 10,245,486 | B2 | 4/2019 | Burgess et al. | |
| 11,097,800 | B1 * | 8/2021 | Trentacosta | A45F 3/04 |
| 2003/0024960 | A1 * | 2/2003 | Greenstein | A45F 3/047 224/153 |
| 2010/0306902 | A1 * | 12/2010 | Bourque | A45C 13/30 2/244 |
| 2011/0000944 | A1 * | 1/2011 | Hood | A41D 27/20 224/576 |
| 2018/0310696 | A1 | 11/2018 | Getter | |
| 2021/0196017 | A1 * | 7/2021 | Goodison | A45C 3/06 |

FOREIGN PATENT DOCUMENTS

| | | | |
|---|---|---|---|
| CN | 102894587 | A * | 1/2013 |
| WO | 2010097208 | A1 | 9/2010 |

* cited by examiner

*Primary Examiner* — Scott T McNurlen

(57) ABSTRACT

Disclosed herein is a novel configurable carrying apparatus that may be configured into a variety of pouch, purse, messenger bag, or other accessory carrying configurations. More specifically, the present invention may include two opposing carrying straps being joinable along one edge with a two-way zipper. The apparatus may be configured into a harness arrangement, a single sling arrangement, a two independent slings arrangement, or a clutch bag arrangement, as well as others. The straps may have a different appearance on each side and be reversible to offer even more wearing variations.

16 Claims, 7 Drawing Sheets

CONFIGURABLE CARRYING APPARATUS

FIELD

The present invention relates to configurable carrying apparatus. More particularly, the present invention relates to configurable carrying apparatus that may be used to support carrying pouches such as satchels, purses, and messenger bags.

BACKGROUND

Traditionally items in the nature of satchels, purses and messenger bags include a carrying apparatus, such as a strap, connected to respective corners of the item. The strap is a singe belt of material intended to be slung over a carrier's shoulder, or over the head and across the chest. Such configurations lack versatility, as well as fashionable wearing options and flair.

More options and versatility integral to the carrying apparatus, such as the satchel strap, are needed. Moreover, an apparatus that is convertible, offering many options for the same carrying bag, is especially desirable. Some bag owners desire a harness carrying arrangement. Other bag owners desire an over the shoulder single sling arrangement. While others desire a clutch bag arrangement. Many desire all three, and more, for functional versatility and to accommodate different accessorizing approaches.

SUMMARY

In exemplary embodiments of the present invention, a convertible carrying apparatus is provided that offers a variety of creative and stylish carrying options all in one integral arrangement.

Specifically, in certain embodiments a double bag harness arrangement is possible. And with quick and easy conversion, a single sling, double independent sling, and clutch configuration are each available.

Additionally, in certain embodiments carrying straps can be quickly adjusted for a variety of lengths. Also, in certain embodiments carrying straps are reversible, and when combined with all the other versatility, facilitate countless stylish configurations and appearances.

BRIEF DESCRIPTION OF DRAWINGS

These and other features, aspects, and advantages of the present invention will become better understood with regard to the following descriptions, and accompanying drawings. It is to be noted, however, that the drawings illustrate only several embodiments of the invention and are therefore not to be considered limiting of the invention's scope as it can admit to other equally effective embodiments.

DETAILED DESCRIPTION

So that the manner in which the features and advantages of embodiments of methods and systems of the present invention may be understood in more detail, a more particular description of the present invention briefly summarized above may be had by reference to certain embodiments thereof that are illustrated in the appended drawings, which form a part of this specification. The drawings illustrate only certain embodiments of the present invention and are, therefore, not to be considered limiting of the scope of the present invention which includes other useful and effective embodiments as well.

Figure 1:
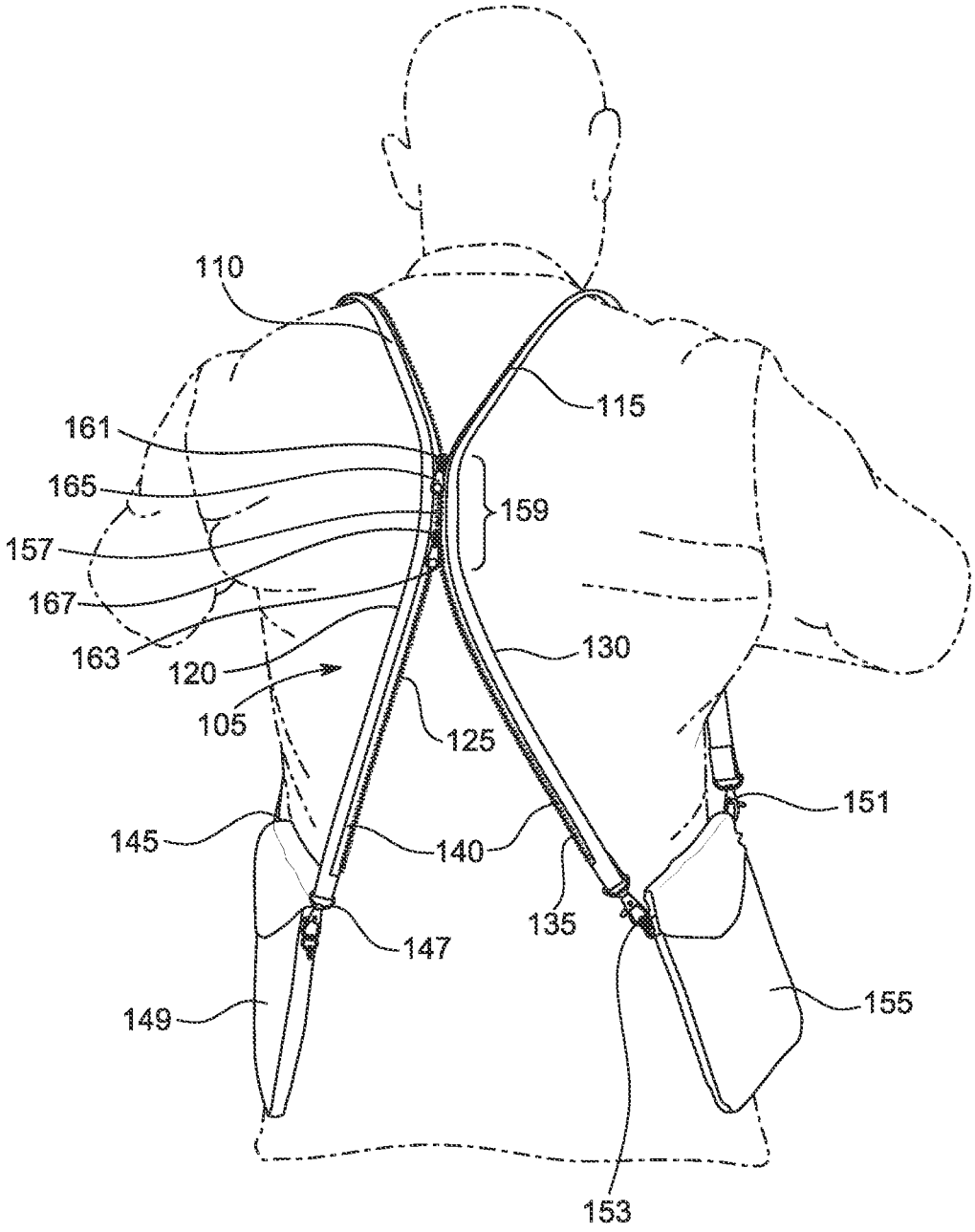
FIG. 1 is a rear view of one embodiment of the present invention illustrating a harness configuration.

Turning to the Figures, FIG. 1 is a rear view of one embodiment of the present invention illustrating a harness configuration. FIG. 1 illustrates configurable carrying apparatus 105. Apparatus 105 comprises a first strap 110 and a second strap 115. Straps 110 and 115 may comprise any material, including without limitation leather or fabric, as may be dictated by fashion and manufacturing choices.

Strap 110 comprises outer edge 120 and inner edge 125. Similarly, strap 115 comprises out edge 130 and inner edge 135. In the illustrated embodiment, inner edge 125 and inner edge 135 are joinable by two-way zipper 140. Inner edge 125 and inner edge 135 may alternatively be joined by a variety of fastening mechanisms, including without limitation, Velcro™, buttons, snaps and clips.

Strap 110 further comprises a first strap first accessory attaching point 145 and a first strap second accessory attaching point 147. Attaching points 145 and 147 may utilize any manner of fastener, including without limitation lobster claw swivels, or squeeze clasps, or a combination of both.

FIG. 1 further illustrates accessory 149. In the illustrated embodiment, accessory 149 is a fashionable pocketed pouch. In alternate embodiments, accessory 149 may be any sort of bag or pouch, including without limitation a purse, satchel, or messenger bag. Moreover, in other embodiments accessory 149 need not be a pouch at all. It may alternatively be any item that one desires to carry suspended from configurable carrying apparatus 105. In the illustrated embodiment, accessory 149 attaches to strap 110 at attaching point 145 and attaching point 147.

Similarly, strap 115 further comprises a second strap first accessory attaching point 151 and a second strap second accessory attaching point 153. Attaching points 151 and 153 may utilize any manner of fastener, including without limitation lobster claw swivels, or squeeze clasps, or a combination of both.

FIG. 1 further illustrates accessory 155. In the illustrated embodiment, accessory 155 is a fashionable pocketed pouch. In alternate embodiments, accessory 155 may be any sort of bag or pouch, including without limitation a purse, satchel, or messenger bag. Moreover, in other embodiments accessory 155 need not be a pouch at all. It may alternatively be any item that one desires to carry suspended from configurable carrying apparatus 105. In the illustrated embodiment, accessory 155 attaches to strap 115 at attaching point 151 and attaching point 153.

Strap 110 extending substantially from attaching point 145 to attaching point 147 comprises a first strap connectable length. In the illustrated embodiment, the connectable length is the length over which zipper 140 extends. It will be recognized that the connectable length may span the entire strap length. Alternatively, the connectable strap length may be shorter than the entire strap length, with the span of the zipper stopping short of either or both ends of the strap.

Similarly, strap 115 extending substantially from attaching point 151 to attaching point 153 comprises a second strap connectable length. In the illustrated embodiment, the connectable length is the length over which zipper 140 extends. It will be recognized that the connectable length may span the entire strap length. Alternatively, the connectable strap length may be shorter than the entire strap length, with the span of the zipper stopping short of either or both ends of the strap.

In the embodiment illustrated in FIG. 1, zipper 140 is a two-way zipper. Straps 110 and 115 are configured to attach (or detach) to (or from) one another along respective inner edges 125 and 135 by two-way zipper 140. The closed portion of zipper 140 forms attached region 157 which has an attached region length 159. Attached region 157 has an upper end 161 and a lower end 163. It will be appreciated that this configuration makes it possible for straps 110 and 115 to connect and/or separate at any point along the straps.

More specifically, by virtue of two-way zipper 140, attached region length 159 can be extended in the direction of attached region upper end 161. Similarly, attached region length 159 can be independently extended in the direction of attached region lower end 163. In certain embodiments the two-way zipper functionality capable of extending in either direction is especially advantageous in that the harness size, fit and appearance can be highly customized for any wearer.

In the illustrated embodiment of FIG. 1, zipper 140 comprises reversible zipper pull 165 and reversible zipper pull 167. Reversible zipper pulls function such that, when straps 110 and 115 are inverted (turned inside out), the metal tab of the pull that is grasped by the fingers swings around a pivot to remain accessible on either side of the zipper. This facilitates the reversibility of configurable carrying apparatus 105.

Specifically, straps 110 and 115 may, in certain embodiments, comprise one appearance, such as color or material, on one outward facing surface, for example the side currently facing away from the wearer, and a different appearance on the other outward facing surface, for example the side currently facing towards the wearer. Either side may be arranged to face away from the wearer's body depending upon which appearance is desired.

Figure 2:
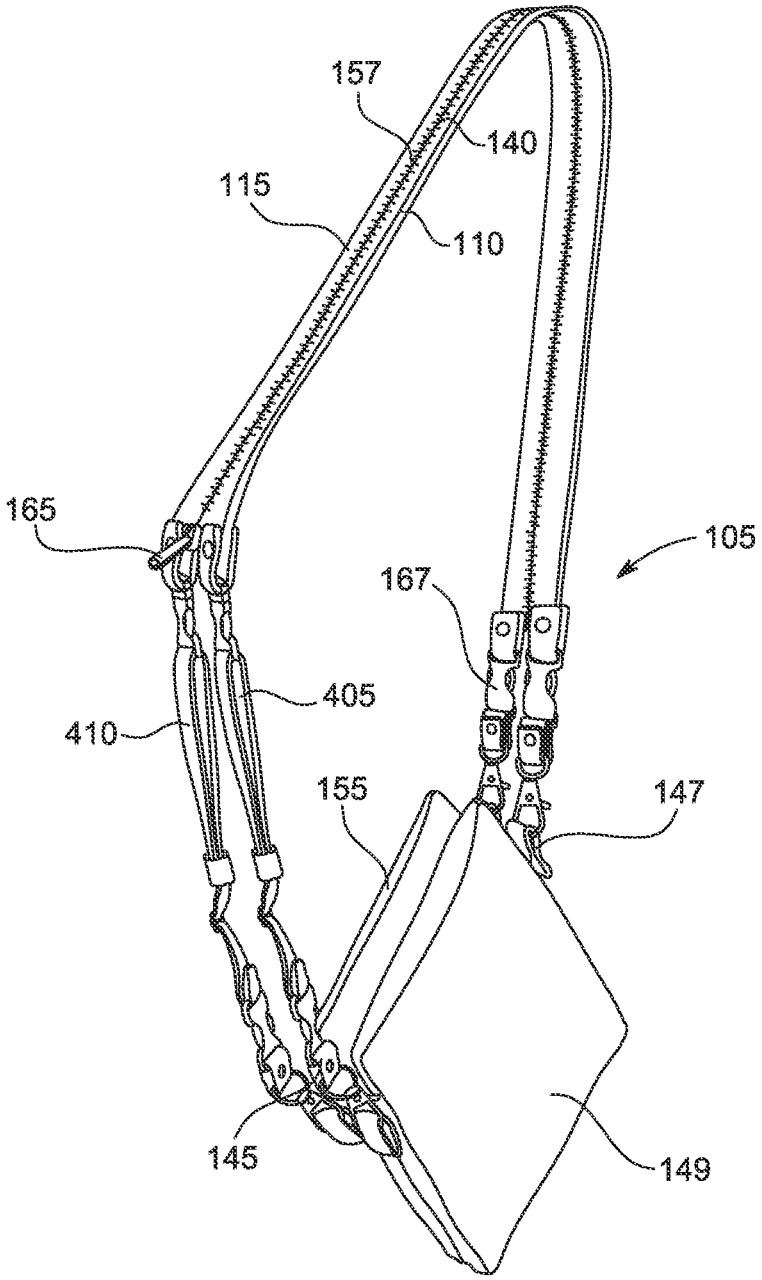
FIG. 2 illustrates a single sling configuration according to one embodiment of the present invention.

Turning now to FIG. 2, FIG. 2 illustrates a single sling configuration according to one embodiment of the present invention. More specifically, FIG. 2 illustrates attached zipper region 157 being extended to substantially the entire connectable length of straps 110 and 115. In effect, zipper 140 is entirely zippered closed. This results in establishing a single sling configuration, wherein straps 110 and 115 are brought together to combine as one. In the illustrated embodiment, both accessories 149 and 155 remain attached. However, a wearer may choose to remove one accessory or the other. The single sling configuration may be worn, as examples, from one shoulder, across the chest, or around the neck with the bag hanging flat against the front of the body. Furthermore, the wearer may choose to remove both accessories, fasten the ends of straps 110 and 115 to one another, thereby creating a belt configuration.

Figure 3:
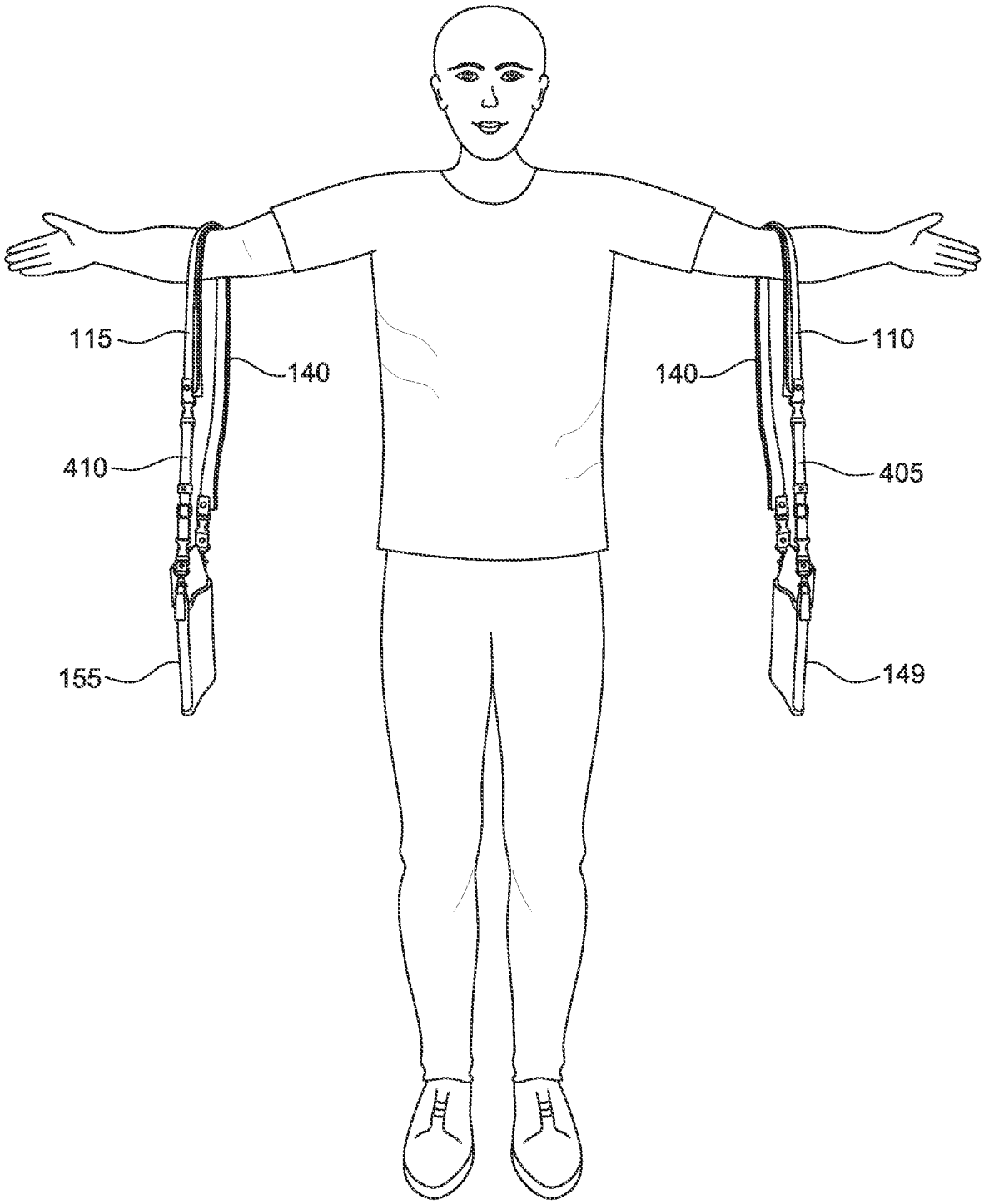
FIG. 3 illustrates the two independent slings configuration according to one embodiment of the present invention.

Turning now to FIG. 3, illustrates the two independent slings configuration according to one embodiment of the present invention. More specifically, the attached region length 159 of attached region 157 (see FIG. 1), is now zero. That is, straps 110 and 115 have been entirely unzipped from one another. This establishes the illustrated two independent slings configuration.

Figure 4:
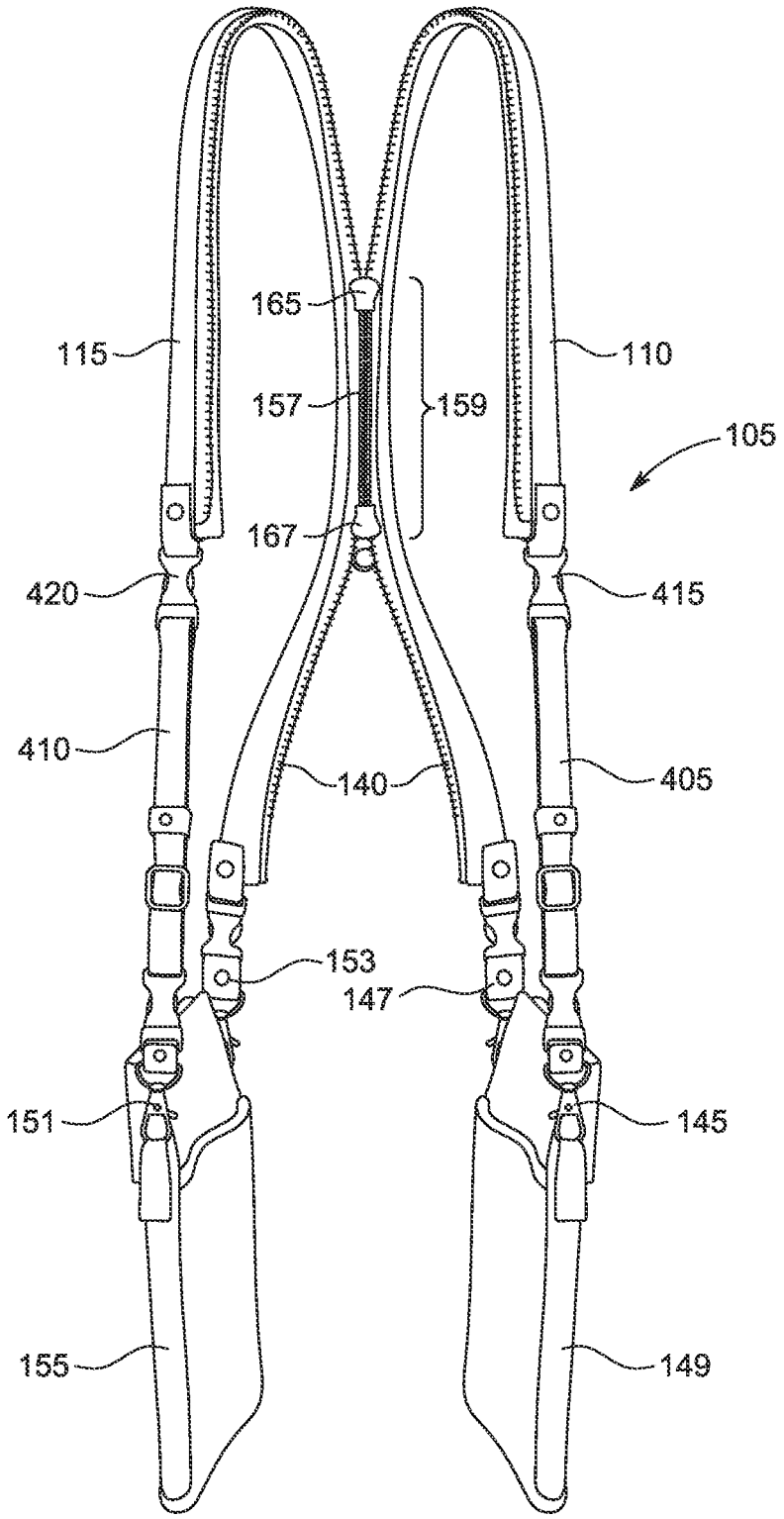
FIG. 4 is a front view illustrating removable strap portions according to one embodiment of the present invention.

Turning now to FIG. 4, FIG. 4 is a front view illustrating removable strap portions according to one embodiment of the present invention. More specifically, the illustrated embodiment comprises removable strap section 405 and removable strap section 410. Removable strap section 405 extends from accessory attaching point 145 to removable strap section attaching point 415. Similarly, removable strap section 410 extends from accessory attaching point 151 to removable strap section attaching point 420. Removable strap section attaching points 415 and 420 may comprise any appropriate connector, including as an example, squeeze clips as illustrated in FIG. 4.

As can be appreciated from the illustration, when removable strap section 405 is detached from attaching points 415 and 145, the remainder of strap 110 may be attached to accessory 149 at attaching point 145. Similarly, when removable strap section 410 is detached from attaching points 420 and 151, the remainder of strap 115 may be attached to accessory 155 at attaching point 151. This results in the straps of configurable carrying apparatus 105 being shortened to suit a wearer's preference.

Turning briefly back to FIG. 2, it will be appreciated that the same shortening can be accomplished for the single sling configuration illustrated in FIG. 2 by removing removable strap sections 405 and 410. And similarly, turning briefly back to FIG. 3, it will be appreciated that the same shortening can be accomplished for the two independent slings configuration illustrated in FIG. 3 by removing removable strap sections 405 and 410.

Returning to FIG. 4, it will be recognized that in certain embodiments straps 110 and 115 will be without removable portions. Such configurations may be non-adjustable, or adjustable by other means such as strap lengths withdrawn or extended through a buckle loop.

Additionally, it will be recognized that a harness-only configuration is possible in certain embodiments. Specifically, accessories 149 and 155 may be entirely removed. Each end of strap 110 may be joined together, and each end of strap 115 may be joined together. This arrangement results in a harness-only configuration without accessories.

Figure 5A:
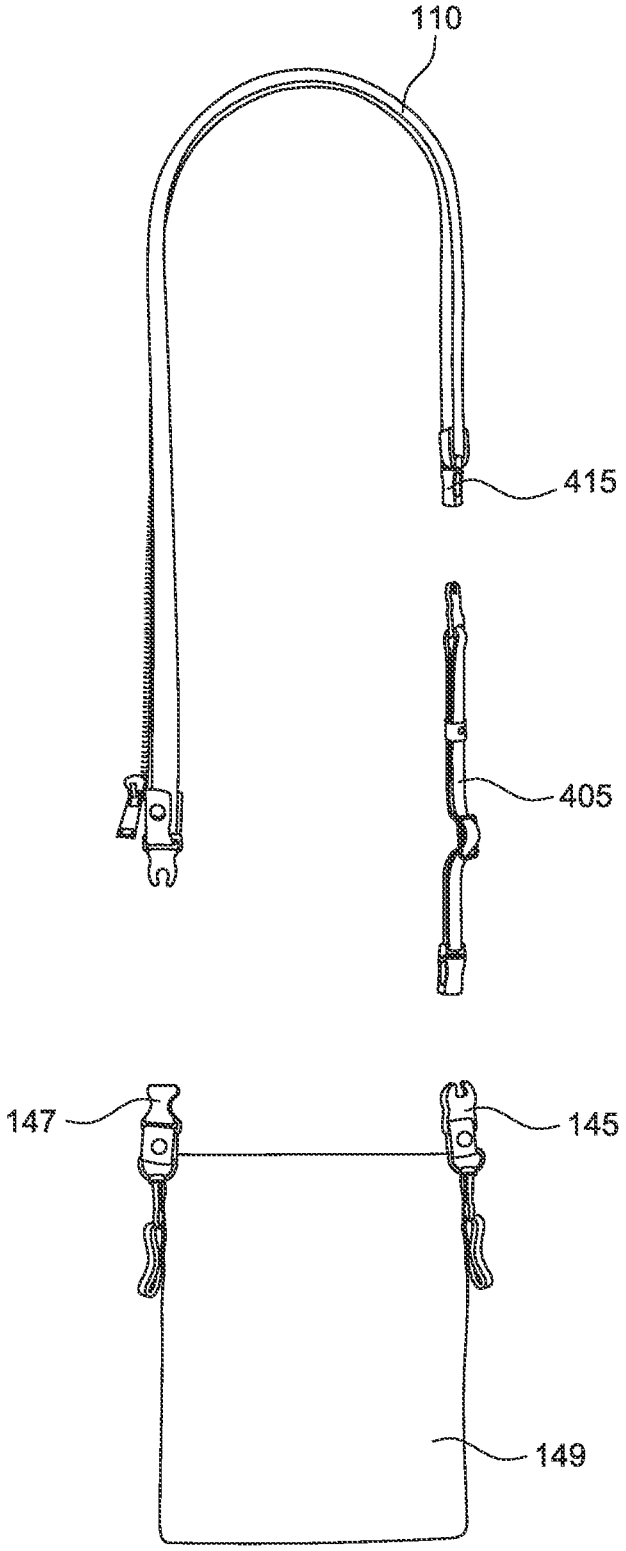
FIG. 5A is a side view illustrating constituent parts of one embodiment of the present invention.

Turning to FIG. 5A, FIG. 5A is a side view illustrating constituent parts of one embodiment of the present invention. FIG. 5A illustrates for ease of reference a disassembled view of one side of configurable carrying apparatus 105. More specifically, FIG. 5A illustrates removable strap section 405 detached from attaching points 145 and 415. Additionally, FIG. 5A illustrates the remainder of strap 110 detached from attaching points 415 and detached from attaching point 147.

Figure 5B:
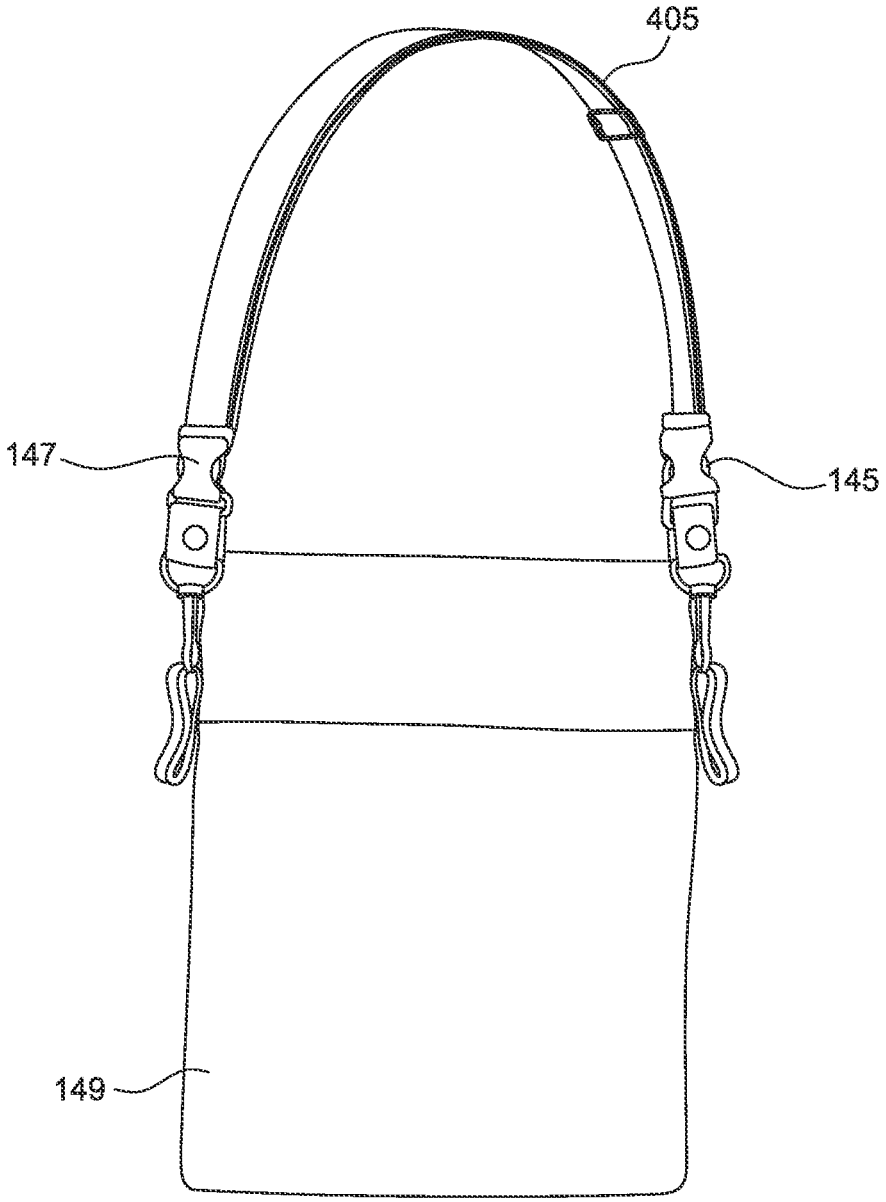
FIG. 5B illustrates a clutch bag configuration according to one embodiment of the present invention.

Turning to FIG. 5B, FIG. 5B illustrates removable strap section 405 reattached at attachment points 145 and 147 to accessory 149. This arrangement results in the clutch bag configuration.

Figure 6:
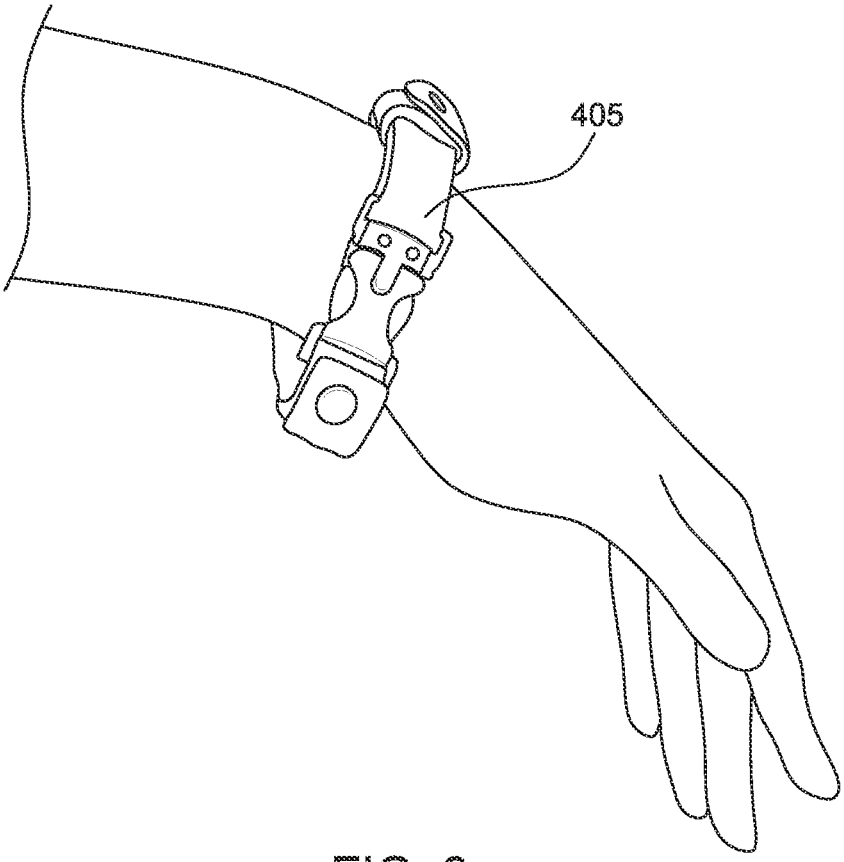
FIG. 6 illustrates a bracelet accessory formed from a removable strap element according to one embodiment of the present invention.

Turning to FIG. 6. FIG. 6 further illustrates the versatility of desirable embodiments of the present invention. Specifically, FIG. 6 illustrates removable strap section 405 being configured for use as a decorative bracelet assembly.

Figure 7:
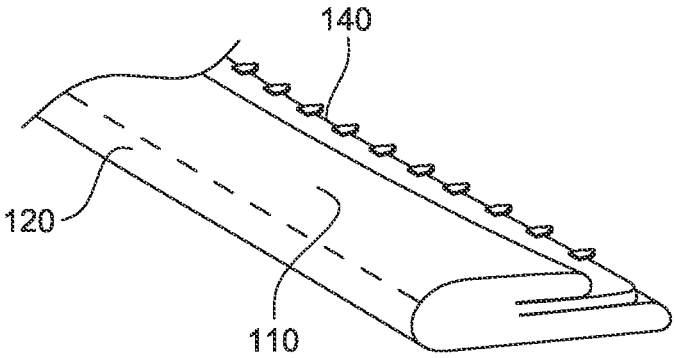
FIG. 7 is a perspective cutaway view illustrating an edgeless strap construction according to one embodiment of the present invention.

Turning to FIG. 7, FIG. 7 is a perspective cutaway view illustrating an edgeless strap construction according to one embodiment of the present invention. More specifically, FIG. 7 illustrates the material comprising strap 110 folded over zipper 140. This configuration forms a smooth seamless edge 120. Traditional construction involves zipper 140 sandwiched between two separate layers of material. That traditional construction results in an edge susceptible to separation and rubbing uncomfortably against the wearer. The inventive configuration illustrated in FIG. 7 results in a more durable edge, with a more pleasing appearance, and which is more comfortable to the wearer.

Consequently, according to the foregoing a convertible carrying apparatus is provided that offers a variety of creative and stylish carrying options all in one integral arrangement.

Specifically, in certain embodiments a double pouch harness arrangement is possible. And with quick and easy conversion, a single sling, double independent sling, and clutch configuration are each available.

Additionally, in certain embodiments carrying straps can be quickly adjusted for a variety of lengths. Also, in certain embodiments carrying straps are reversible, and when combined with all the other versatility, facilitate countless stylish configurations and appearances.

The foregoing description of the embodiments of the invention has been presented for the purpose of illustration; it is not intended to be exhaustive or to limit the invention to the precise forms disclosed. The description and drawings are, accordingly, to be regarded in an illustrative rather than a restrictive sense. The language used in the specification has been principally selected for readability and instructional purposes. It is therefore intended that the scope of the invention be limited not by this detailed description and drawings, but rather by any claims that issue based on this application. It will, however, be evident that various modifications and changes may be made thereunto without departing from the broader spirit and scope of the invention.

What is claimed is:

1. A configurable carrying apparatus comprising:

a first strap comprising a first strap outer edge, a first strap inner edge, a first strap connectable length, a first strap first accessory attaching point, and a first strap second accessory attaching point;

a second strap comprising a second strap outer edge, a second strap inner edge, a second strap connectable length, a second strap first accessory attaching point, and a second strap second accessory attaching point;

wherein the first strap and second strap are configured to attach to one another along the first strap inner edge and the second strap inner edge, forming an attached region comprising an attached region length, an attached region upper end and an attached region lower end, wherein the attached region length can be extended in the direction of the attached region upper end and the attached region length can be independently extended in the direction of the attached region lower end;

a first accessory coupled to the first strap at the first strap first accessory attaching point, and at the first strap second accessory attaching point; and a second accessory coupled to the second strap at the second strap first accessory attaching point, and at the second strap second accessory attaching point.

2. The configurable carrying apparatus of claim 1, wherein when the attached region length is extended to substantially the entire first strap connectable length, a single sling configuration is established.

3. The configurable carrying apparatus of claim 1, wherein when the attached region length is decreased to zero the first strap and the second strap become entirely separated and a two independent slings configuration is established.

4. The configurable carrying apparatus of claim 1, wherein the first strap inner edge and the second strap inner edge are joined by a two-way zipper.

5. The configurable carrying apparatus of claim 4, the two-way zipper further comprising a reversible slider zipper pull, and wherein the first strap and the second strap have a first appearance on a first outwardly facing surface and a second appearance on a second outwardly facing surface.

6. The configurable carrying apparatus of claim 1, further comprising a removable strap section extending from the first strap first accessory attaching point to a removable strap section attaching point, wherein the first strap is configured to attach to the first accessory at the removable strap section attaching point when the removable strap section is removed.

7. The configurable carrying apparatus of claim 1, further comprising a removable strap section extending from the first strap first accessory attaching point to a removable strap section attaching point, wherein when the removable strap section is detached from a remainder of the first strap at the removable strap section attaching point and attached to the accessory at the first strap second accessory attaching point a clutch bag configuration is established.

8. A configurable carrying apparatus comprising:

a first strap comprising a first strap outer edge, a first strap inner edge, a first strap connectable length, a first strap first accessory attaching point, first strap second accessory attaching point, and first strap removable strap section extending from the first strap first accessory attaching point to a first strap removable strap section attaching point;

a second strap comprising a second strap outer edge, a second strap inner edge, a second strap connectable length, a second strap first accessory attaching point, second strap second accessory attaching point, and second strap removable strap section extending from the second strap first accessory attaching point to a second strap removable strap section attaching point;

wherein the first strap and second strap are configured to attach to one another along the first strap inner edge and the second strap inner edge, forming an attached region comprising an attached region length, an attached region upper end and an attached region lower end, wherein the attached region length can be extended in the direction of the attached region upper end and the attached region length can be independently extended in the direction of the attached region lower end; and a first accessory coupled to the first strap removable strap section at the first strap first accessory attaching point, and coupled to the first strap at the first strap second accessory attaching point; and a second accessory coupled to the second strap removable strap section at the second strap first accessory attaching point, and coupled to the second strap at the second strap second accessory attaching point.

9. The configurable carrying apparatus of claim 8, wherein when the attached region length is extended to the entire first strap connectable length, a single sling configuration is established.

10. The configurable carrying apparatus of claim 8, wherein when the attached region length is decreased to zero the first strap and the second strap become entirely separated and a two independent slings configuration is established.

11. The configurable carrying apparatus of claim 8, wherein the first strap inner edge and the second strap inner edge are joined by a two-way zipper.

12. The configurable carrying apparatus of claim 11, the two-way zipper further comprising a reversible slider zipper pull, and wherein the first strap and the second strap have a first appearance on a first outwardly facing surface and a second appearance on a second outwardly facing surface.

13. The configurable carrying apparatus of claim 11, wherein the first strap is configured to attach to the first accessory at the first strap removable strap section attaching point when the first strap removable strap section is removed.

14. The configurable carrying apparatus of claim 8, wherein when the first strap removable strap section is detached from a remainder of the first strap at the first strap removable strap section attaching point and attached to the accessory at the first strap second accessory attaching point a clutch bag configuration is established.

15. A configurable carrying apparatus comprising:

a first strap comprising a first strap outer edge, a first strap inner edge, a first strap connectable length, a first strap first accessory attaching point, first strap second accessory attaching point, and first strap removable strap section extending from the first strap first accessory attaching point to a first strap removable strap section attaching point;

a second strap comprising a second strap outer edge, a second strap inner edge, a second strap connectable length, a second strap first accessory attaching point, second strap second accessory attaching point, and second strap removable strap section extending from the second strap first accessory attaching point to a second strap removable strap section attaching point;

wherein the first strap and second strap are configured to attach to one another along the first strap inner edge and the second strap inner edge, forming an attached region comprising an attached region length, an attached region upper end and an attached region lower end, wherein the attached region length can be extended in the direction of the attached region upper end and the attached region length can be independently extended in the direction of the attached region lower end;

wherein the first strap inner edge and the second strap inner edge are joined by a two-way zipper, the two-way zipper comprising a reversible slider zipper pull, and wherein the first strap and the second strap have a first appearance on a first outwardly facing surface and a second appearance on a second outwardly facing surface; and a first accessory coupled to the first strap removable strap section at the first strap first accessory attaching point, and coupled to the first strap at the first strap second accessory attaching point; and a second accessory coupled to the second strap removable strap section at the second strap first accessory attaching point, and coupled to the second strap at the second strap second accessory attaching point.

16. The configurable carrying apparatus of claim 15, wherein when the attached region length is extended to the entire first strap connectable length, a single sling configuration is established.

* * * * *